United States Patent [19]

Mobley et al.

[11] Patent Number: 4,888,799

[45] Date of Patent: Dec. 19, 1989

[54] SCRAMBLING OF SIGNALS BY INVERSION

[75] Inventors: Joseph G. Mobley, Dunwoody; Anatoly Kozushin, Duluth; Saeed Baher; Steve Addison, both of Atlanta; Howard Paulk, Woodstock; James Farmer, Doraville, all of Ga.

[73] Assignee: Scientific Atlanta, Inc., Atlanta, Ga.

[21] Appl. No.: 815,912

[22] Filed: Jan. 3, 1986

[51] Int. Cl.[4] ..... H04K 1/04

[52] U.S. Cl. ..... 380/6; 380/19; 380/38

[58] Field of Search ..... 358/118, 124; 179/1.5 R, 1.5 S; 380/19, 38, 9, 6, 39, 17

[56] References Cited

U.S. PATENT DOCUMENTS

| | | | |
|---|---|---|---|
| 2,402,058 | 6/1946 | Loughren | 179/1.5 |
| 2,987,576 | 6/1961 | Druz et al. | 179/1.5 |
| 3,073,892 | 1/1963 | Druz | 178/5.1 |
| 3,098,936 | 7/1963 | Isabeau | 307/88.5 |
| 3,123,672 | 3/1964 | Ross | 179/1.5 |
| 3,610,828 | 10/1971 | Girard | 179/1.5 S |
| 3,624,297 | 11/1971 | Chapman | 380/39 |
| 3,651,268 | 3/1972 | Rivkin | 179/1.5 M |
| 4,022,972 | 5/1977 | Pires | 380/17 |
| 4,195,202 | 3/1980 | McCalmont | 380/39 |
| 4,221,931 | 9/1980 | Seiler | 179/1.5 |
| 4,253,114 | 2/1981 | Tang et al. | 358/114 |
| 4,257,065 | 3/1981 | Papay | 380/17 |
| 4,305,152 | 12/1981 | Asakawa et al. | 380/39 |
| 4,308,556 | 12/1981 | Osaka | 380/17 |
| 4,398,215 | 8/1983 | Osaka | 380/17 |
| 4,429,331 | 1/1984 | Kanai | 380/17 |
| 4,443,660 | 4/1984 | DeLong | 178/22.04 |
| 4,598,318 | 7/1986 | Robbins | 380/17 |
| 4,599,648 | 7/1986 | Fujii et al. | 358/124 |
| 4,628,358 | 12/1986 | Robbins . | |
| 4,679,078 | 7/1987 | Wong et al. | 380/17 |
| 4,679,235 | 7/1987 | Okada et al. | 380/17 |
| 4,773,092 | 9/1988 | Huang | 380/9 |

OTHER PUBLICATIONS

Spencer, *Frequency Inverter Scrambles Voices*, EDN Magazine, vol. 29, No. 12, Jun. 14, 1984, pp. 238–240.

Bhargava, Digital Communication by Satellite, John Wiley, New York, 1981, pp. 275–281.

*Primary Examiner*—Salvatore Cangialosi

*Attorney, Agent, or Firm*—Banner, Birch, McKie & Beckett

[57] ABSTRACT

The present invention is directed to an inversion scrambler and unscrambler having pseudo-randomly controlled polarity-reversing switches to invert and re-invert, respectively, an audio signal so as to restrict the intelligent dissemination of the audio signal. To improve security of the scrambled signal, the audio signal is concealed prior to scrambling. Concealment includes clamping the original audio signal to a predetermined value and optionally offsetting this clamped signal prior to scrambling. The concealed signal is scrambled by inverting contiguous portions of the signal at pseudo-random intervals, accomplished by a polarity-reversing switching network controlled by a pseudo-random code generator. Upon unscrambling, artifacts will appear at the inversion points of the unscrambling signal, due to bandwidth limitations inherent in any transmission path. To mask the artifacts, track-and-hold circuitry is used to sample the unscrambled audio signal waveform level just prior to the artifact and hold this level throughout the short period when the artifact would occur.

9 Claims, 2 Drawing Sheets

SCRAMBLING OF SIGNALS BY INVERSION

BACKGROUND OF THE INVENTION

1. Field of the Invention

The present invention relates to the scrambling of intelligence signals, in order to prevent the receipt by unauthorized persons of the intelligence contained in them, and to the unscrambling the scrambled signal, by an authorized recipient, in a manner which reduces the noise introduced into the scrambled signal during the scrambling/unscrambling process.

2. Description of the Related Art

Inversion of selected portions of a signal (that is, multiplication of the signal values of selected portions by $-1$) is well known as a security measure.

For example, in U.S. Pat. No. 2,402,058 issued to Loughren and herein incorporated by reference, inversion of an audio signal is controlled by a signal developed from a cathode ray tube/code card/photocell arrangement. The code card is placed in front of the CRT and is generally opaque, but has a plurality of randomly placed and shaped apertures which allow the CRT's electron beam to project through the code card, developing an inversion control signal at the output of the photocell. The control signal is random in that the pattern on the code card which generates the inversion control signal is dependent upon the spacing and configuration of the card's apertures, which are themselves random. Both the encoder and decoder employ identical code cards, which are replaceable with ones having different aperture patterns. The control signal has a slightly higher fundamental frequency range than the audio to be encoded, and the control and audio signals are effectively mixed by modulating the audio signal on the control signal, thereby producing upper and lower sidebands. During transmission, only the lower sideband is transmitted, further concealing the original audio signal. However, the use of single sideband transmission relaxes the precision of the control signal on the decoder side. To compensate, Loughren combines one or more constant frequency tones with the audio signal prior to inversion, which are removed at the decoder by a sharply tuned rejector filter. These constant frequencies are best added a only during intervals of active audio, hindering an authorized listener from deducing these added frequency values.

Other types of pseudo-random inversion signal generators are also known in the art. For example, U.S. Pat. No. 3,610,828 issued to Girard et al., herein incorporated by reference, describes a polarity-reversing switch controlled by a code generator which emits a series of binary signals in synchronism with a clock. Based on the value of the code generator, the polarity-reversing switch either inverts the audio signal or passes it unaffected. The code generator is a shift register in which the contents of the last stage control the state of the polarity-reversing switch. The shift register is provided with internal feedback connections to provide a series of pseudo-random output bits in response to the clock pulse. Additionally, a code selector network is included for insuring that both the encoder and the decoder are synchronized: should they not have the identical code in their respective code selector networks, the decoder will not properly decode the encoded signal. For added security, this code could easily and frequently be changed by the user. To help conceal the original audio signal, a d.c. voltage, dependent upon the state of the polarity-reversing switch, is added to the signal prior to its inversion.

There are several problems with inversion scrambling techniques as found in the above references. For example, to help conceal the original audio, signals of either constant amplitude or constant frequency are added to the original audio signal, usually only during intervals of active audio by a switching network. A major disadvantage of using a constant amplitude or constant frequency signal to conceal the original audio signal is that its consistency can easily be detected as background noise when the audio signal is low amplitude or low frequency. Additionally, if the switching network does not cut off the concealing signal exactly at the termination of the audio signal, an authorized listener can readily detect the signal's change of state, thereby isolating the concealing signal's characteristics.

In addition, a problem exists due to the inherent bandwidth limitations of the transmission path. At each inversion, an abrupt transition, mathematically described as the sum of a series of an infinite number of frequencies, each frequency having a different amplitude, occurs. As all transmission paths have a limited bandwidth, some of these higher frequencies will be lost during transmission of the scrambled signal. Accordingly, an artifact will appear at the inversion points of the unscrambled signal.

U.S. Pat. No. 2,987.576 issued to Druz et al., herein incorporated by reference, tries to solve the problem of bandwidth limitation. Druz unscrambles the audio signal and splits the unscrambled audio into two paths prior to output. The first path includes a sampler for sampling the unscrambled audio signal and a low-pass filter network for removing the artifact; the second path contains a delay network so that the outputs of the first and second paths are synchronous. An electronic switch outputs the true unscrambled audio at all points in time except when the artifact, due to inversion, occurs. At the inversion points, the switch outputs the filtered unscrambled audio signal for a predetermined period of time. Thus, at the inversion points, a filtered version of the unscrambled audio signal is output for a predetermined interval. Although the Druz system tries to correct the problems inherent with limited bandwidth transmission paths, the correction signal itself contains undesired distortion caused by noise components which have been demodulated down into the audio range by the sampler. Thus, distortion introduced during the inversion scrambling/unscrambling process is present in the final output audio signal.

SUMMARY OF THE INVENTION

Accordingly, it is an object of the present invention to conceal an audio signal with a signal which is not constant in amplitude, frequency, or periodicity.

It is also an object of the present invention to conceal au audio signal using inversion scrambling and to recover the signal in a manner which reduces the transient distortion and extraneous noise components introduced during the inversion scrambling/unscrambling process.

It is further an object of the present invention to isolate and remove the distortion in the recovered audio signal by not including any portion of the distortion-prone signal in the output signal.

The present invention is directed to an inversion scrambler and unscrambler having pseudo-randomly controlled polarity-reversing switches to invert and re-invert, respectively, an audio signal so as to restrict the intelligent dissemination of the audio signal. The audio signal to be scrambled is concealed prior to inversion to improve the security of the scrambled signal. Concealment is a function of the original audio signal, and is therefore never predictable, nor of constant amplitude, frequency, or periodicity. An envelope detector detects the value of the audio signal's envelope, and this detected envelope is subtracted from the original audio signal, producing a clamped version of the original audio signal (all amplitudes above a predetermined potential are clamped to this predetermined level). This clamping feature can also be performed by a standard clamping circuit, well-known to those skilled in the art. The clamped signal can optionally be masked by adding to it a constant-value signal, further concealing the original audio signal's envelope pattern. The concealed signal is scrambled by inverting contiguous portions of the signal at pseudo-random intervals, accomplished by a polarity-reversing switching network controlled by a pseudo-random code generator, both known in the art. The scrambled signal has sharp transitions at the points of inversion which can be mathematically expressed as a series of infinite frequencies, each frequency having a different amplitude. Due to the bandwidth limitations inherent in any transmission path, the higher frequency components of the scrambled signal will not be transmitted. Upon unscrambling with a polarity-reversing switch having the identical pseudo-random code generator as the scrambler, artifacts will appear at the inversion points of the unscrambled signal. To mask this artifact, track-and-hold circuitry is used to sample the unscrambled audio signal waveform level just prior to the artifact and hold this level throughout the short period when the artifact would occur (during the inversion interval). Thus, the track-and-hold circuitry eliminates the transient distortion attributable to the inherent bandwidth limitations of the transmission path by not including any part of the distortion-prone signal in the output signal.

DESCRIPTION OF THE PREFERRED EMBODIMENT

Figure 1:
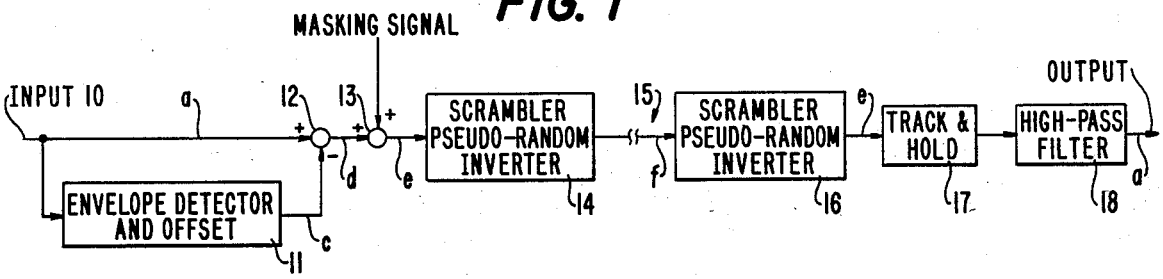
FIG. 1 is a simplified block diagram of a portion of a communication system using the present invention.
Figure 2:
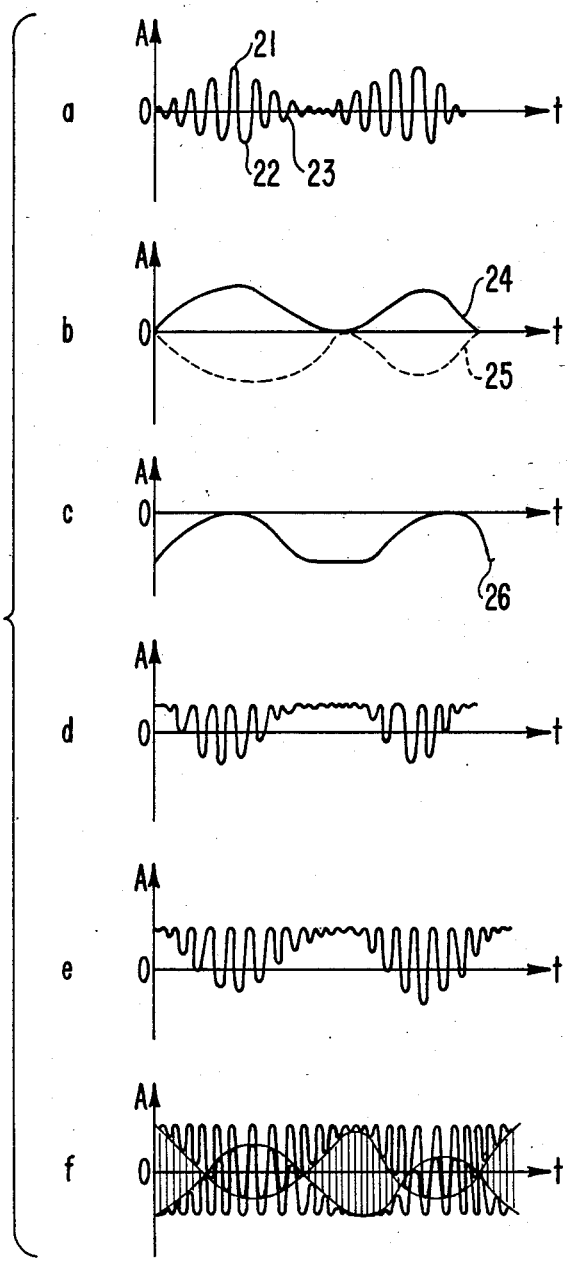
FIG. 2 is a series of amplitude-vs.-time diagrams of the signals appearing at various points in the system of FIG. 1.

Turning now to FIGS. 1 and 2, the pseudo-random phase inversion system will now be discussed. FIG. 1 is a simplified block diagram of the pseudo-random phase inversion system. FIG. 2 is an amplitude - vs. time diagram of a signal as it proceeds through the pseudo-random phase inversion system.

As shown in FIG. 1, an audio intelligence signal (such as signal a of FIG. 2) is input at input 10. The signal is sinusoidal in nature, having alternating positive peaks 21 and negative peaks 22 separated by zero-crossings 23. Zero-crossings occur at the signal's zero-reference level, labelled "O" in FIG. 2.

Signal a is concealed prior to inversion to improve the security of the scrambled signal, by adding a signal (signal c, FIG. 2) which is a function of the original audio signal. There are many advantages to this, such as maintaining the maximum frequency and amplitude ranges of the original signal. Additionally, the concealing signal is impossible to isolate from the scrambled signal, for it is a function of the original signal.

Concealment is accomplished as follows: signal a is input to envelope detector 11, which develops an envelope signal (signal b, FIG. 2) representative of the positive or negative portions of the envelope of amplitude variations of signal a. In the preferred embodiment, envelope detector 11 detects the positive portion of the envelope (24 in FIG. 2), and the detected envelope is offset so that the peaks of the envelope are terminated at the signal's zero-reference value, as shown at c in FIG. 2.

The negative of the offset envelope c output from envelope detector 11 is algebraically added to signal a at the negative input of summing junction 12, producing signal d of FIG. 2. As is evident from FIG. 2, the positive peaks of signal d are adjusted to a predetermined level not substantially equal to the zero-reference level (0). Alternatively, envelope detector 11 could detect the negative portion of the envelope (25 in FIG. 2), offset this envelope so that its peaks are terminated at the signal's zero-reference level, and algebraically add the positive of the offset envelope to signal a.

Signal d can also be obtained by clamping the positive or negative peaks of signal a to a predetermined level, using a conventional clamping circuit well known in the art. For example, a capacitor in series with a diode will produce a signal clamped to zero when the output is taken across the diode. To clamp to any level other than zero, it is only necessary to add a d.c. source.

Signal d is further masked by the addition of a masking signal at summing junction 13. In the preferred embodiment, the masking signal has a constant value (is a zero-frequency signal). Addition of the masking signal to signal d produces signal e.

The masked signal from summing junction 13 (signal e) is input to scrambler pseudo-random inverter 14, where the masked signal is inverted at pseudo-random inversion points, described in more detail with reference to FIG. 3 below. Inverter 14 inverts the masked signal, producing the scrambled signal shown at f in FIG. 2.

The scrambled signal is transmitted on transmission path 15 to unscrambler pseudo-random inverter 16, which unscrambles the scrambled signal. Path 15 could include a transmitter/receiver, antennas, optical fibers, wire or any other transmission path elements known in the art.

Inverter 16 could recover the scrambled signal in one of two possible ways. It could either invert all portions of the scrambled signal that were not inverted by inverter 14, thereby recovering signal d, or it could invert all portions of the scrambled signal that were inverted by inverter 14, thereby recovering the inverse of signal d, which is equivalent. In the preferred embodiment, inverter 16 re-inverts all portions of the signal that were inverted by the scrambler, as described in more detail with reference to FIG. 3, below.

At the inversion points, artifacts appear in the unscrambled signal, for the transmission path has a finite bandwidth. Because the sharp transitions resulting from inversion have frequency components much higher than can be practicable transmitted, these higher frequency components are lost in transmission. Distortion caused by these lost frequency components manifests itself as artifacts at the inversion points, and these artifacts are eliminated by track-and-hold circuit 17. Track-and-hold circuit 17 removes the artifact by sampling the unscrambled signal just prior to each inversion point and holding this value throughout a predetermined short period when the artifact would occur. After this short period, the decoded signal is passed unaffected. The period must be short when compared with the average frequency of switching between the inverted and non-inverted signals.

The original audio signal a is recovered from signal e by high-pass filter 18.

Figure 3:
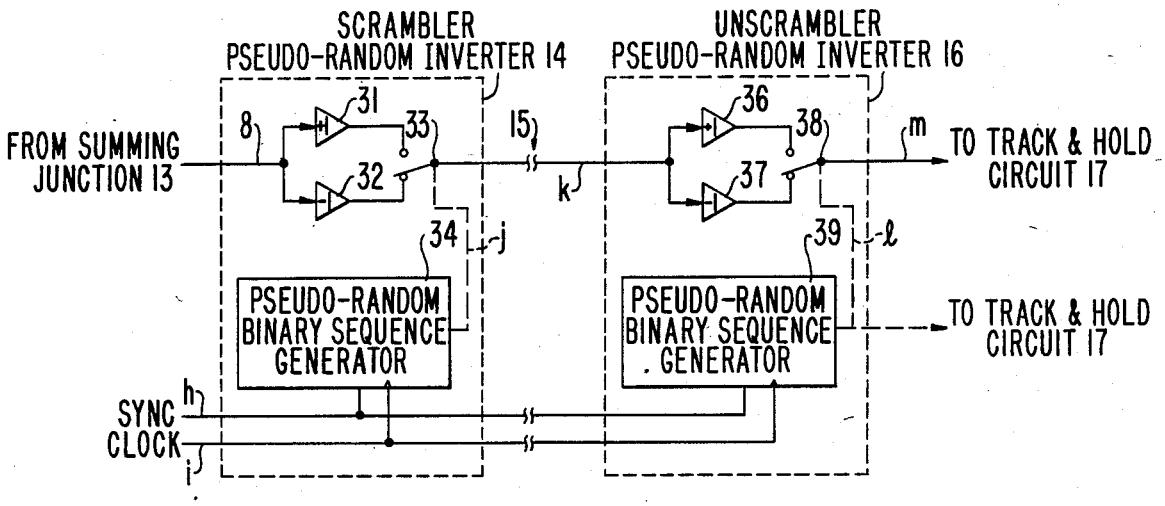
FIG. 3 is a block diagram illustrating in more detail the inverters shown in FIG. 1.
Figure 4:
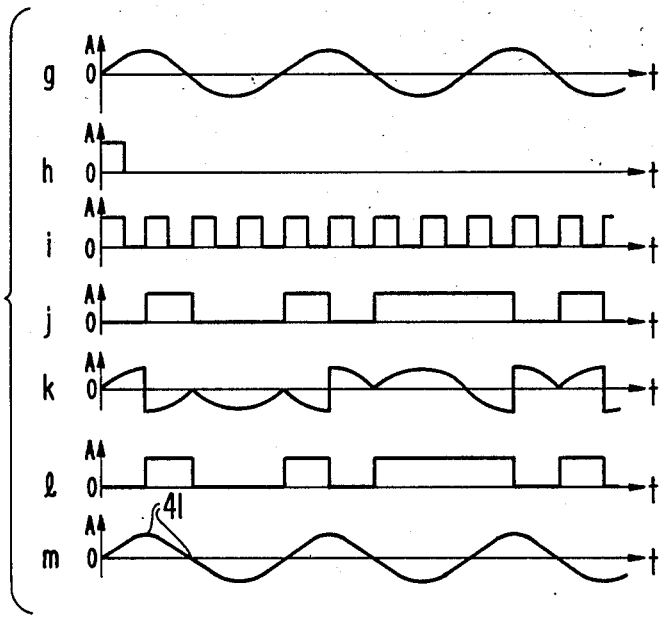
FIG. 4 is a series of amplitude-vs.-time diagrams of the signals appearing at various points in the circuits of FIG. 3.

Turning now to FIGS. 3 and 4, the operations of the inverters (14 and 16) of FIG. 1 will now be discussed in more detail.

As shown in FIG. 3, signal g (an original audio signal to be scrambled) is input to both non-inverting path 31 and inverting path 32. Switch 33 is connected to the outputs of both paths and is actuable, to select between them, according to the value of a control signal, generated by pseudo-random binary sequence generator 34. Switch 33 changes between its two states according to whether the control signal is above or below a predetermined level, and such switches are well known in the art.

To generate a control signal having one of two possible levels, generator 34 is a square-wave generator having pseudo-randomly occuring level changes. In the preferred embodiment, generator 34 comprises a clocked shift register having internal feedback through selector switches, wherein the last stage of the shift register controls switch 33. The selector switches determine the pattern of the control signal; the pattern in which they are set is a predetermined key which is readily changeable by the user. Thus, even if an unauthorized listener has the requisite unscrambling hardware, the scrambled signal will be unintelligible without the proper key.

The control signal is pseudo-random since the instants of time at which switch 33 changes state are unpredictable unless one knows at least the shift register cycle. Accordingly, a large shift register is desirable. In the preferred embodiment, the shift register is 32 bits long.

Generator 34 is sychronized and clocked by signals h and i of FIG. 4, respectively, and an example of a control signal generated by generator 34 is shown as signal j. The masked signal from summing junction 13 (FIG. 1) is inverted during the time interval between the pseudo-random instants of time when the control signal is above the predetermined level. The masked signal is inverted, as shown at k in FIG. 4, according to the control signal j. The scrambled audio signal is then transmitted on path 15, where it is received by inverter 16.

Inverter 16 reinverts the portions of the signal which were inverted by inverter 14 by generating pseudo-random controls signals identical to those generated by inverter 14. Non-inverting and inverting paths 36 and 37, respectively, are selected by switch 38, which is controlled by pseudo-random binary sequence generator 38. Generators 34 and 39 are identically configured and are synchronized by supplying each with identical synchronization and clock pulses. Thus, the control signal of generator 39, shown as signal l in FIG. 4, is identical to control signal j. Inverted signal k is recovered by inverter 16, as shown at m in FIG. 4.

Unscrambled signal m (FIG. 4g) contains artifacts 41 at the inversion points due to the limited bandwidth of transmission path 15. To remove these artifacts, track-and-hold circuit 17 samples the unscrambled signal just prior to the inversion points and outputs this constant value throughout a predetermined short period, in order to eliminate the artifact. After the short period, the unscrambled signal is again passed unaffected through track-and-hold circuit 17, which then outputs a signal proportional to the signal appearing at its input. The short period is usually less than 1 us. Generator 39 controls the initiation of the hold feature of track-and-hold circuit 17 by the same control signal that controls switch 38.

In the application of scrambling an audio signal associated with a television signal, the clock and synchronization pulses could be derived from the video horizontal sync pulses and a video vertical sync pulse, respectively. In the preferred embodiment, the generators are synchronized every eight fields, with the exact field flagged through an existing data path. Additionally, since the clock rate should ideally be between 0.6 and 1.6 kHz, the horizontal sync pulse train is divided by 16 to obtain a clock rate slightly under 1 kHz.

This invention is not limited to the exact implementation illustrated above. A complete digital system could easily be designed following the teachings of this invention, and would include an analog-to-digital converter for digitizing the audio signal, digital circuitry (such as a square-wave generator or software-controlled gates) for performing the pseudo-random inversions, and a digital-to-analog converter for recovering the original analog signal. Other variations are also possible.

Although illustrative embodiments of the present invention have been described in detail with reference to the accompanying drawings, it is to be understood that the invention is not limited to those precise embodiments, and that various changes or modifications may be effected therein by one skilled in the art without departing from the scope or spirit of the invention.

What is claimed is:

1. A method of scrambling a received audio signal, said method comprising the steps of:

obtaining a derived signal from said received audio signal, combining said derived signal with said received audio signal to produce a combined audio signal; and inverting at least one selected portion of said combined audio signal.

2. The method of claim 1 wherein the step of obtaining a derived signal comprises the steps of:

detecting an envelope corresponding to the envelope of said received audio signal; and adjusting the detected envelope so that the peaks of the detected envelope are substantially equal to a predetermined level.

3. The method of claim 2 wherein the step of adjusting comprises the step of adjusting the positive or negative peaks of the detected envelope to the predetermined level.

4. The method of claim 1 further comprising the step of adding a masking signal of a predetermined value to the combined audio signal before inverting the selected portion.

5. The method of claim 4 wherein the masking signal has a constant value.

6. The method of claim 1 wherein said step of inverting at least one selected portion comprises the steps of:

pseudo-randomly selecting two instants of time separated by a time interval; and inverting audio said combined signal during the time interval.

7. The method of claim 1 wherein said step of inverting a selected portion comprises pseudo-randomly inverting the said combined audio signal according to a predetermined key.

8. A scrambler for selectively inverting an audio signal comprising:

receiving means for receiving said audio signal;

concealing means responsive to said receiving means for concealing said audio signal prior to said signal being selectively inverted; and means for selectively inverting said concealed audio signal;

wherein said concealing means comprises:

means for obtaining a derived signal from said received audio signal and for combining said derived signal with said received audio signal.

9. The scrambler of claim 8 wherein said means for obtaining a derived signal comprises:

means for detecting an envelope corresponding to the envelope of the received audio signal; and means for offsetting the detected envelope so that peaks of the envelope are substantially equal to a predetermined reference level.

* * * * *